US010615527B2

(12) United States Patent
Ou

(10) Patent No.: US 10,615,527 B2
(45) Date of Patent: Apr. 7, 2020

(54) ELECTRICAL CONNECTOR

(71) Applicant: LOTES CO., LTD, Keelung (TW)

(72) Inventor: Zi Sheng Ou, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/438,688

(22) Filed: Jun. 12, 2019

(65) Prior Publication Data

US 2019/0393632 A1 Dec. 26, 2019

(30) Foreign Application Priority Data

Jun. 22, 2018 (CN) ..... 2018 1 0652467

(51) Int. Cl.
*H01R 12/71* (2011.01)
*H01R 13/24* (2006.01)

(52) U.S. Cl.
CPC ..... *H01R 12/714* (2013.01); *H01R 13/2435* (2013.01); *H01R 13/2471* (2013.01)

(58) Field of Classification Search
CPC .. H01R 12/714; H01R 12/70; H01R 13/2471; H01R 13/2435
See application file for complete search history.

(56) References Cited

U.S. PATENT DOCUMENTS 4,505,529 A 3/1985 Barkus
8,888,525 B2 * 11/2014 Yeh ..... H01R 13/17 439/539
10,103,470 B2 * 10/2018 Ju ..... H01R 13/2435
10,116,080 B1 * 10/2018 Ju ..... H01R 12/52
10,276,953 B2 * 4/2019 Huang ..... H01R 12/57
10,326,225 B2 * 6/2019 Ju ..... H01R 12/7076
10,389,050 B2 * 8/2019 Huang ..... H01R 12/7076
10,535,946 B2 * 1/2020 Ho ..... H01R 12/7076

FOREIGN PATENT DOCUMENTS

CN 2726150 Y 9/2005
CN 2932681 Y 8/2007
CN 200959390 Y 10/2007
CN 200972934 Y 11/2007
CN 107528139 A 12/2017

* cited by examiner

*Primary Examiner* — Xuong M Chung Trans
(74) *Attorney, Agent, or Firm* — Locke Lord LLP; Tim Tingkang Xia, Esq.

(57) ABSTRACT

An electrical connector includes an upper insulating shell and a lower insulating shell, and at least one conductive terminal. The conductive terminal has an elastic portion located between the upper insulating shell and the lower insulating shell. The elastic portion has a first elastic arm and a second elastic arm. An upper connecting portion is located above the first elastic arm and the second elastic arm and accommodated in the upper insulating shell. The upper connecting portion extends to form an upper contact portion protruding out of the upper insulating shell. A lower connecting portion is located below the first elastic arm and the second elastic arm and accommodated in the lower insulating shell. The lower connecting portion extends to form a lower contact portion protruding out of the lower insulating shell.

16 Claims, 12 Drawing Sheets

100

100

200

200

200

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201810652467.2 filed in China on Jun. 22, 2018. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector having elastic terminals.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In the Chinese Patent No. CN200620075644.8, an electrical connector for electrically connecting a chip module with a circuit board includes an upper tray, a lower tray and multiple conductive terminals. The upper tray and the lower tray are correspondingly provided with channels equal to the conductive terminals in quantity. Each conductive terminal includes a C-shaped base continuously extending and an upper contact arm and a lower contact arm extending out from the upper end and the lower end of the base. The tail ends of the upper contact arm and the lower contact arm are both provided to be tip ends, and two ends of the upper and lower contact arms are respectively inserted into the channels in the upper and lower trays and extend out of the surfaces of the upper and lower trays, so as to electrically contact with the chip module and the conductive portion of the circuit board. The conductive terminals are fixed on the electrical connector by interference fit between the tail ends of the upper and lower contact arms and the channels in the upper and lower trays.

The chip module presses downward on the conductive terminals, and elastic force produced by bending deformation of the C-shaped base functions as a normal force for supporting the chip module. However, the C-shaped base is relatively thick, and its rigidity is great while its elasticity is small, such that greater strength is needed in mating with the chip module for pressing so as to maintain a stable connection.

Therefore, a heretofore unaddressed need to design a new electrical connector exists in the art to address the aforementioned deficiencies and inadequacies.

SUMMARY

The present invention is directed to an electrical connector with conductive terminals having elastic sensitivity by providing two separate conductive elastic arms at each conductive terminal.

In order to achieve the foregoing objective, the present invention adopts the following technical solution:

An electrical connector includes: an upper insulating shell and a lower insulating shell; and at least one conductive terminal, wherein the at least one conductive terminal has an elastic portion located between the upper insulating shell and the lower insulating shell, the elastic portion has a first elastic arm and a second elastic arm, an upper connecting portion is located above the first elastic arm and the second elastic arm and accommodated in the upper insulating shell, the upper connecting portion extends to form an upper contact portion protruding out of the upper insulating shell, a lower connecting portion is located below the first elastic arm and the second elastic arm and accommodated in the lower insulating shell, and the lower connecting portion extends to form a lower contact portion protruding out of the lower insulating shell; wherein the first elastic arm has a first bending portion bending toward one side thereof and a first widening portion located on the first bending portion, a width of the first widening portion is greater than a width of a remaining portion of the first elastic arm, the second elastic arm has a second bending portion bending toward one side thereof and a second widening portion located on the second bending portion, and a width of the second widening portion is greater than a width of a remaining portion of the second elastic arm.

In certain embodiments, the upper insulating shell has at least one upper channel for accommodating the upper connecting portion, an upper position limiting portion is formed between the upper connecting portion and the elastic portion to upward abut the upper insulating shell, the lower insulating shell has at least one lower channel for accommodating the lower connecting portion, and a lower position limiting portion is formed between the lower connecting portion and the elastic portion to downward abut the lower insulating shell.

In certain embodiments, the first widening portion protrudes from the first bending portion toward the second bending portion, the second widening portion protrudes from the second bending portion toward the first bending portion, and the first widening portion and the second widening portion are provided at an interval.

In certain embodiments, the first widening portion is located at a center of the first bending portion; and the second widening portion is located at a center of the second bending portion.

In certain embodiments, the first bending portion is located at a center of the first elastic arm; and the second bending portion is located at a center of the second elastic arm.

In certain embodiments, the first bending portion and the second bending portion bend toward a same side.

In certain embodiments, the upper connecting portion, the upper position limiting portion, the first elastic arm, the second elastic arm, the lower position limiting portion and the lower connecting portion enclose a through hole.

In certain embodiments, a width of the upper connecting portion and a width of the lower connecting portion are respectively smaller than a width of the elastic portion, and a width of the through hole in the upper connecting portion and in the lower connecting portion is smaller than the width of the through hole in the elastic portion.

In certain embodiments, an included angle between a horizontal projection of the upper channel and a horizontal projection of a side edge of the upper insulating shell is 45°, and an included angle between a horizontal projection of the lower channel and a horizontal projection of a side edge of the lower insulating shell is 45°.

In certain embodiments, the upper position limiting portion and the lower position limiting portion respectively have two oblique surfaces, the upper channel and the lower channel respectively have at least two chamfers, and the oblique surfaces abut the chamfers.

In certain embodiments, the upper connecting portion and the lower connecting portion are flat plate shaped, and the upper connecting portion and the lower connecting portion are coplanar.

In certain embodiments, the first elastic arm and the second elastic arm bend toward different directions away from each other.

In certain embodiments, a first arrangement direction is defined to be perpendicular to a vertical direction, and two adjacent conductive terminals are arranged along the first arrangement direction, wherein the first bending portion of one of the two adjacent conductive terminals, in a bending direction, passes beyond the second bending portion of the other of the two adjacent conductive terminals.

In certain embodiments, a second arrangement direction is defined to be perpendicular to the first arrangement direction, the upper connecting portion and the lower connecting portion are flat plate shaped, and projections of the first elastic arm and the second elastic arm along the second arrangement direction are in mirror symmetry relative to a plane on which the upper connecting portion and the lower connecting portion are located.

In certain embodiments, two conductive terminals are arranged along the second arrangement direction and adjacent to each other, and in the second arrangement direction, the two conductive terminals are symmetric to each other relative to a center line between the two conductive terminals.

In certain embodiments, in the first arrangement direction, the first bending portion and the second bending portion of one of the conductive terminals respectively pass beyond the plane on which the upper connecting portion and the lower connecting portion of adjacent conductive terminals are located.

Compared with the related art, the present invention has the following beneficial effects:

The elastic portion of the conductive terminal has the first elastic arm and the second elastic arm separate from each other, such that the elasticity of the elastic portion is increased, and the chip module presses downward on the conductive terminal more easily. The first elastic arm and the second elastic arm form two conductive paths, so as to improve the impedance of the conductive terminal. Further, each bending portion is provided with the widening portion, so as to prevent the conductive terminal from being fatigue due to excessive narrow widths of the first elastic arm and the second elastic arm, and increase the widths of the first elastic arm and the second elastic arm to increase the compatibility of the conductive terminal so as to improve the high frequency transmission performance.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
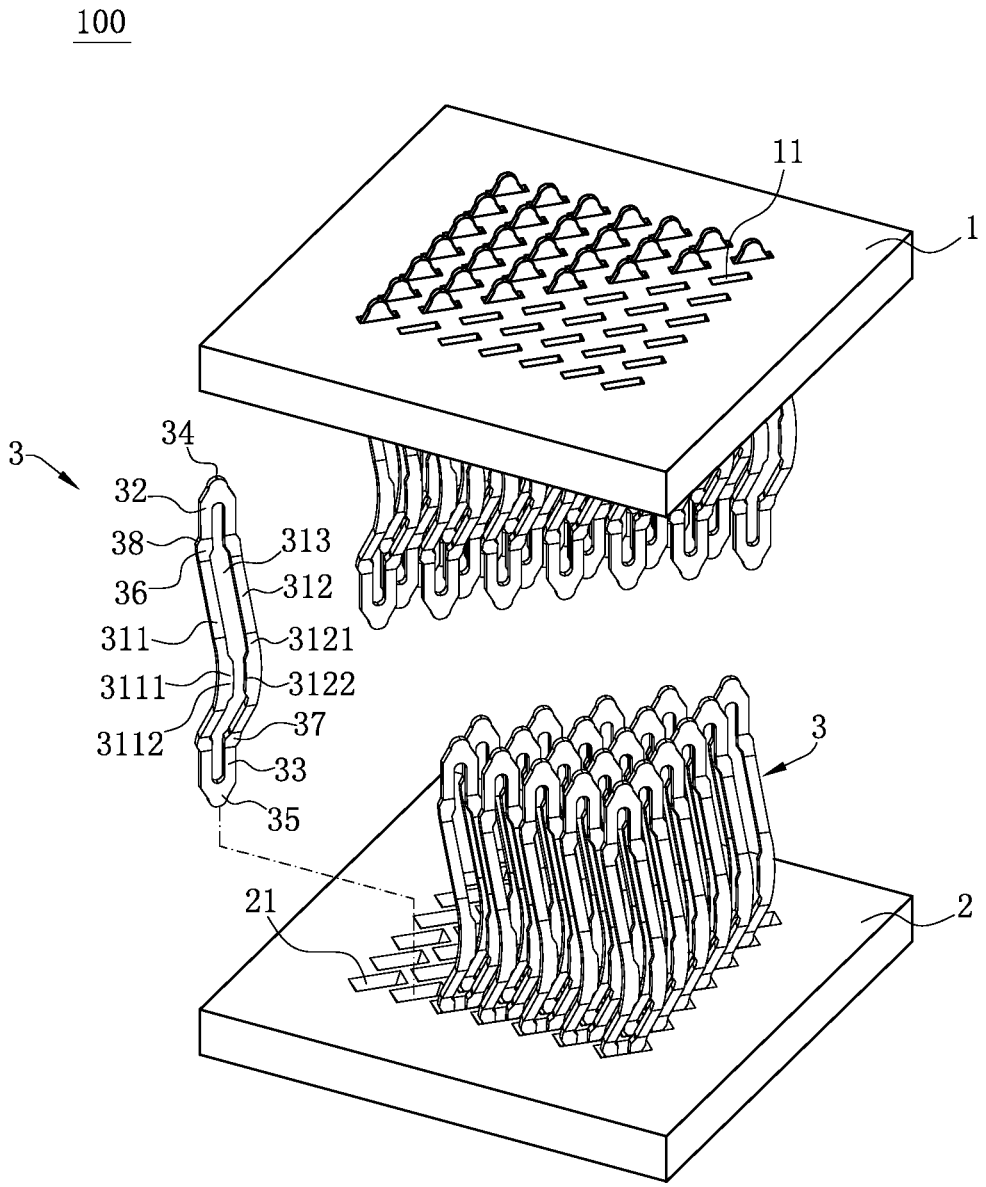
FIG. 1 is a perspective exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-12. In accordance with the purposes of this invention, as embodied and broadly described herein, this invention, in one aspect, relates to an electrical connector.

FIG. 1 to FIG. 5 shows an electrical connector 100 according to a first embodiment of the present invention. The electrical connector 100 is used for electrically connecting a chip module 300 to a circuit board 400, and includes two insulating shells, which are an upper insulating shell 1 and a lower insulating shell 2 respectively, and multiple conductive terminals 3 mounted to the two insulating shells.

Figure 2:
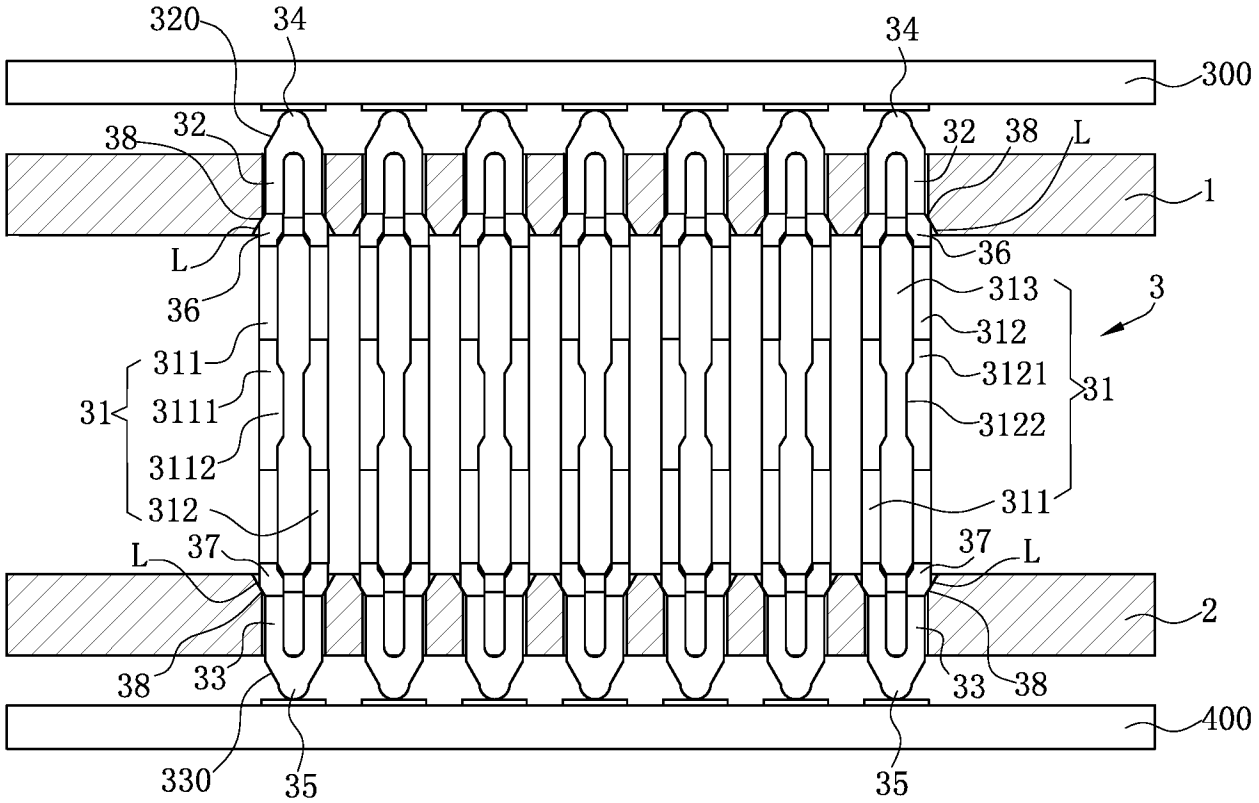
FIG. 2 is a sectional view of the electrical connector according to the first embodiment of the present invention.
Figure 5:
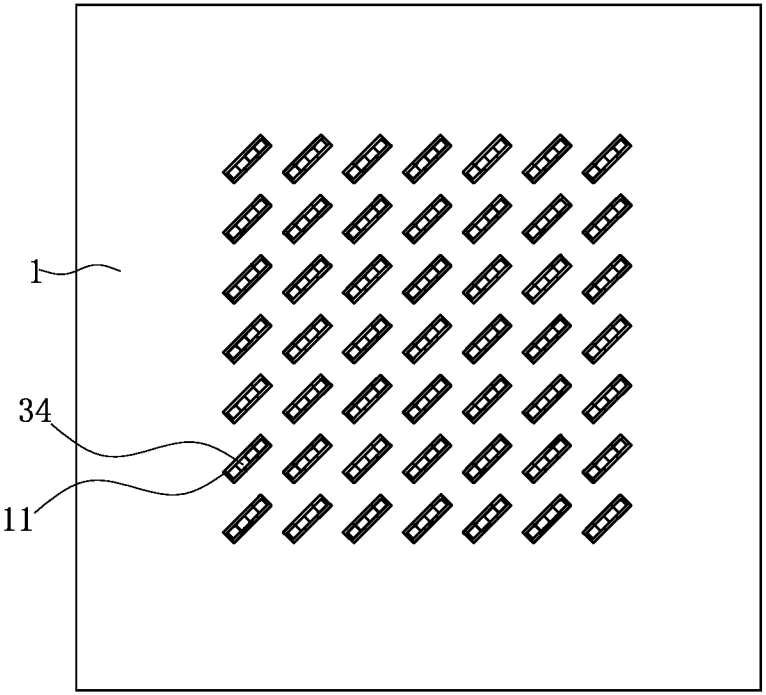
FIG. 5 is a top view of the electrical connector according to the first embodiment of the present invention.

As shown in FIG. 1, FIG. 2 and FIG. 5, the two insulating shells are both square flat plate shaped structures. Each of the insulating shells has multiple channels equal to the conductive terminals 3 in quantity. Correspondingly, the channels of the upper insulating shell 1 are upper channels 11, and the channels of the lower insulating shell 2 are lower channels 21. The upper channels 11 and the lower channels 21 are respectively used for accommodating the conductive terminals 3. The upper channels 11 and the lower channels 21 respectively have two chamfers L, which are used for guiding entrance of the conductive terminals 3. As shown in FIG. 5, an included angle between a horizontal projection of each upper channel 11 and a horizontal projection of a side edge of the upper insulating shell 1 is 45°, and an included angle between a horizontal projection of each lower channel 21 and a horizontal projection of a side edge of the lower insulating shell 2 is 45°.

Figure 3:
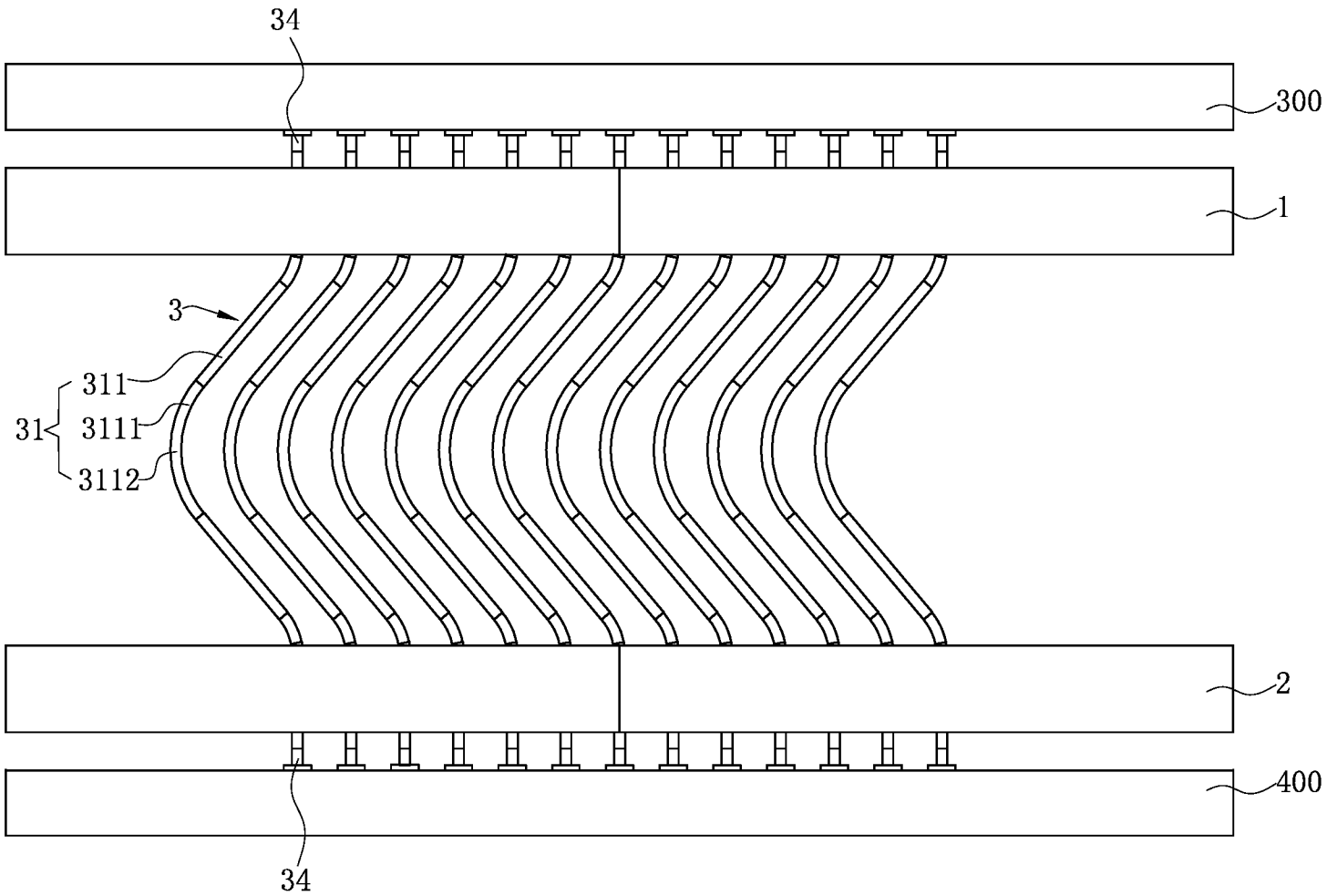
FIG. 3 is a side view of the electrical connector according to the first embodiment of the present invention, where the conductive terminals are not pressed.
Figure 4:
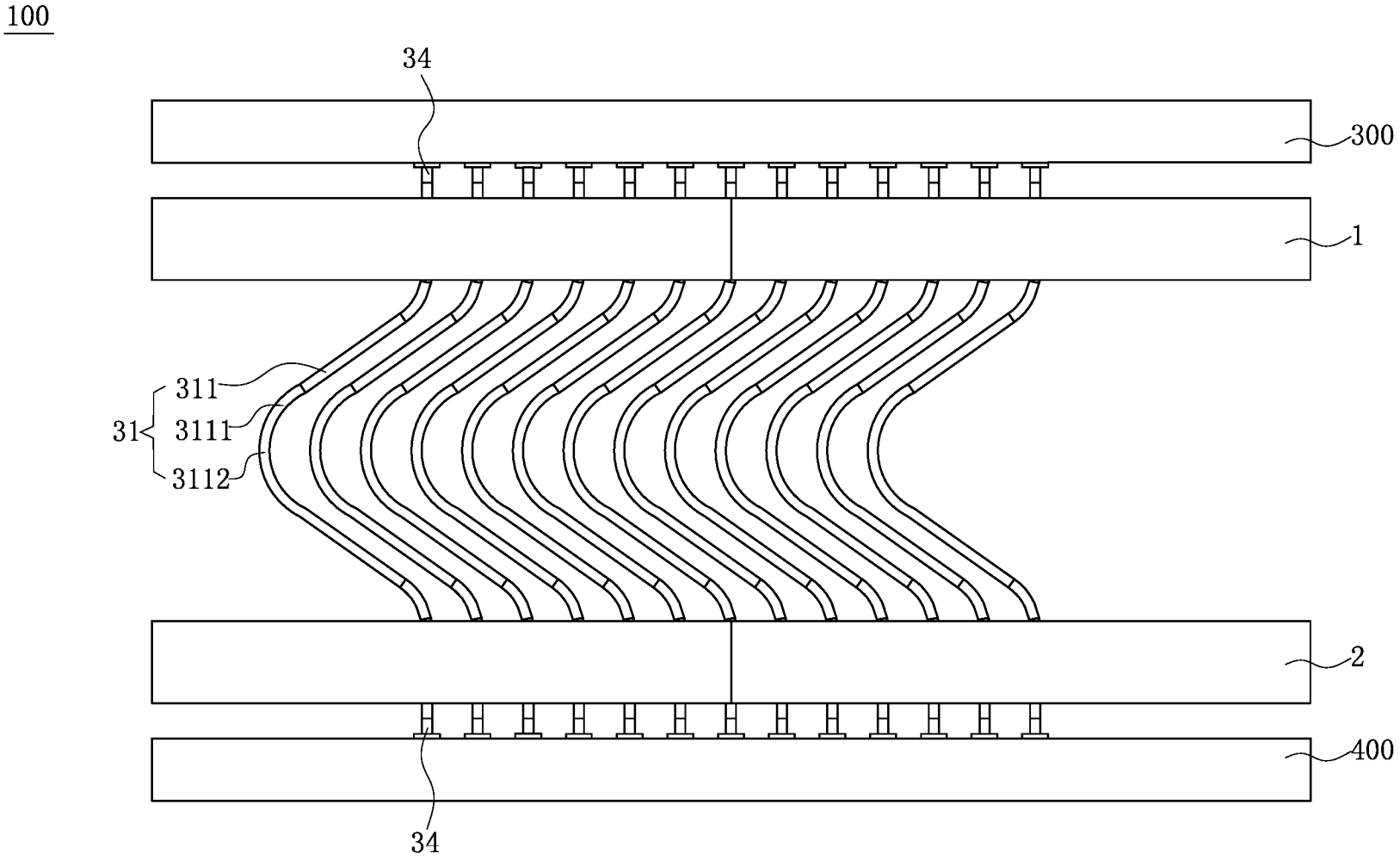
FIG. 4 is a side view of the electrical connector according to the first embodiment of the present invention, where the conductive terminals are pressed.

As shown in FIG. 1 to FIG. 3, each conductive terminal 3 includes a C-shaped elastic portion 31. The elastic portion 31 is located between the upper insulating shell 1 and the lower insulating shell 2, and has a first elastic arm 311, a second elastic arm 312 parallel to the first elastic arm 311, and a through hole 313 located between the first elastic arm 311 and the second elastic arm 312. The first elastic arm 311 has a first bending portion 3111 located at a center of the first elastic arm 311 and bending toward one side thereof. The second elastic arm 312 has a second bending portion 3121 located at a center of the second elastic arm 312 and bending toward the same side as the first bending portion 3111 does. A center of the first bending portion 3111 protrudes toward the second bending portion 3121 to form a first widening portion 3112. A width of the first widening portion 3112 is greater than a width of a remaining portion of the first elastic arm 311. A center of the second bending portion 3121 protrudes toward the first bending portion 3111 to form a second widening portion 3122. A width of the second widening portion 3122 is greater than a width of a remaining portion of the second elastic arm 312. The first widening portion 3112 and the second widening portion 3122 are provided at an interval.

As shown in FIG. 1 and FIG. 2, the conductive terminal 3 also includes two connecting portions that are flat plate shaped and coplanar, two contact portions and two position limiting portions. The two connecting portions are respectively an upper connecting portion 32 and a lower connecting portion 33. The upper connecting portion 32 passes through the upper channel 11. The lower connecting portion 33 passes through the lower channel 21. The upper connecting portion 32 has an upper guiding portion 320 with its width shrinking upward, configured to guide the conductive terminal 3 to pass upward through the upper insulating shell 1. The upper guiding portion 320 extends upward out of the upper insulating shell 1. The lower connecting portion 33 has a lower guiding portion 330 with its width shrinking downward, configured to guide the conductive terminal 3 to pass downward through the lower insulating shell 2. The lower guiding portion 330 extends downward out of the lower insulating shell 2. The two contact portions are respectively formed by extending in a converging way from the two connecting portions, and are respectively an upper contact portion 34 and a lower contact portion 35. The upper contact portion 34 is located at a tail end of the upper connecting portion 32 and upward protrudes out of the upper insulating shell 1 to contact the chip module 300. The lower contact portion 35 is located at a tail end of the lower connecting portion 33 and downward protrudes out of the lower insulating shell 2 to contact the circuit board 400. The two position limiting portions are respectively an upper position limiting portion 36 and a lower position limiting portion 37. The upper position limiting portion 36 is located between the upper connecting portion 32 and the elastic portion 31, and the lower position limiting portion 37 is located between the lower connecting portion 33 and the elastic portion 31. Each of the position limiting portions includes two oblique surfaces 38 formed by the side edges of the conductive terminal 3. As shown in FIG. 2, the oblique surfaces 38 abut the chamfers L, so as to limit a protruding distance of the upper contact portion 34 relative to the upper insulating shell 1 and a protruding distance of the lower contact portion 35 relative to the lower insulating shell 2. As shown in FIG. 2, the through hole 313 is enclosed by the upper connecting portion 32, the upper position limiting portion 36, the first elastic arm 311, the lower position limiting portion 37, the lower connecting portion 33 and the second elastic arm 312. The through hole 313 respectively penetrates through the upper position limiting portion 36 and the lower position limiting portion 37 to enter the upper connecting portion 32 and the lower connecting portion 33, and a width of the through hole 313 in the upper connecting portion 32 and in the lower connecting portion 33 is smaller than the width of the through hole 313 in the elastic portion 31.

FIG. 6 to FIG. 12 shows an electrical connector 200 according to a second embodiment of the present invention. The electrical connector 200 includes two insulating shells, which are respectively an upper insulating shell 4 and a lower insulating shell 5, and multiple conductive terminals 6 which are mounted between the two insulating shells. The two insulating shells are similar to the two insulating shells of first embodiment, which are square flat plate shaped structures and have multiple channels. Each conductive terminal 6 includes an elastic portion 61 located between the upper insulating shell 4 and the lower insulating shell 5. The elastic portion 61 includes a first elastic arm 611 and a second elastic arm 612 which bend toward directions away from each other, and a through hole 613 which is located between the first elastic arm 611 and the second elastic arm 612. A first bending portion 6111 is provided at a center of the first elastic arm 611. The first bending portion 6111 protrudes to form a first widening portion 6112, and a width of the first widening portion 6112 is greater than a width of the remaining portion of the first elastic portion 611. A second bending portion 6121 is provided at a center of the second elastic arm 612. The second bending portion 6121 protrudes to form a second widening portion 6122, and a width of the second widening portion 6122 is greater than a width of the remaining portion of the second elastic arm 612. Each conductive terminal 6 also includes an upper connecting portion 62 and a lower connecting portion 62', which are flat plate shaped and respectively located above and below the elastic portion 61, and are respectively accommodated in the upper insulating shell 4 and the lower insulating shell 5; an upper contact portion 63 and a lower contact portion 63', which are respectively located at the tail ends of the upper connecting portion 62 and the lower connecting portion 62' and respectively protrude out of the upper insulating shell 4 and the lower insulating shell 5; and an upper position limiting portion 64 and a lower position limiting portion 64'. The upper position limiting portion 64 is located between the elastic portion 61 and the upper connecting portion 62. The lower position limiting portion 64' is located between the elastic portion 61 and the lower connecting portion 62'. The upper position limiting portion 64 and the lower position limiting portion 64' respectively abut the upper insulating shell 4 and the lower insulating shell 5 so as to limit the protruding distances of the upper contact portion 63 and the lower contact portion 63'.

Figure 6:
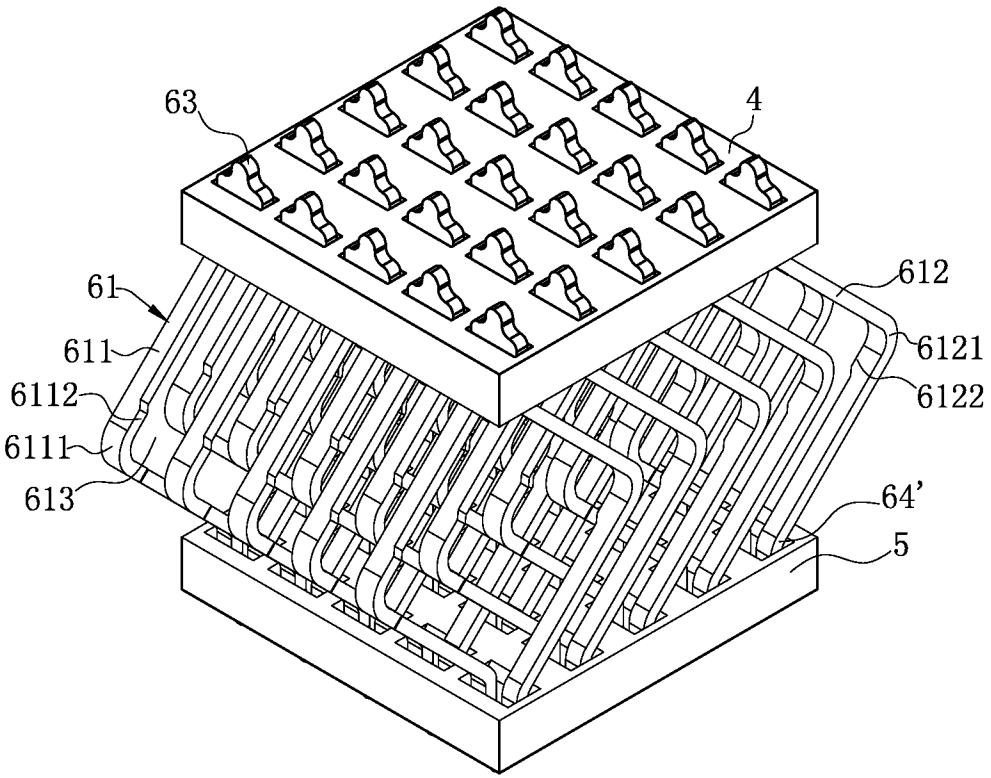
FIG. 6 is perspective view of the electrical connector according to a second embodiment of the present invention.
Figure 7:
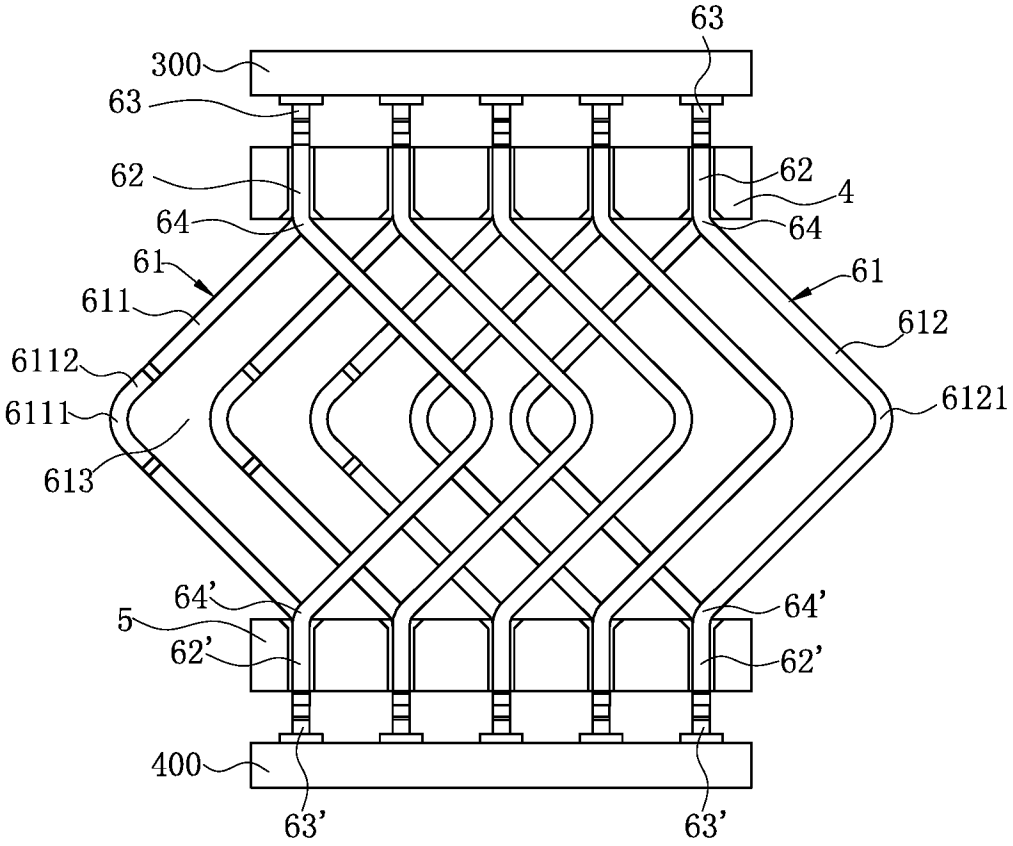
FIG. 7 is a side view of the electrical connector according to the second embodiment of the present invention, where the conductive terminals are not compressed.
Figure 8:
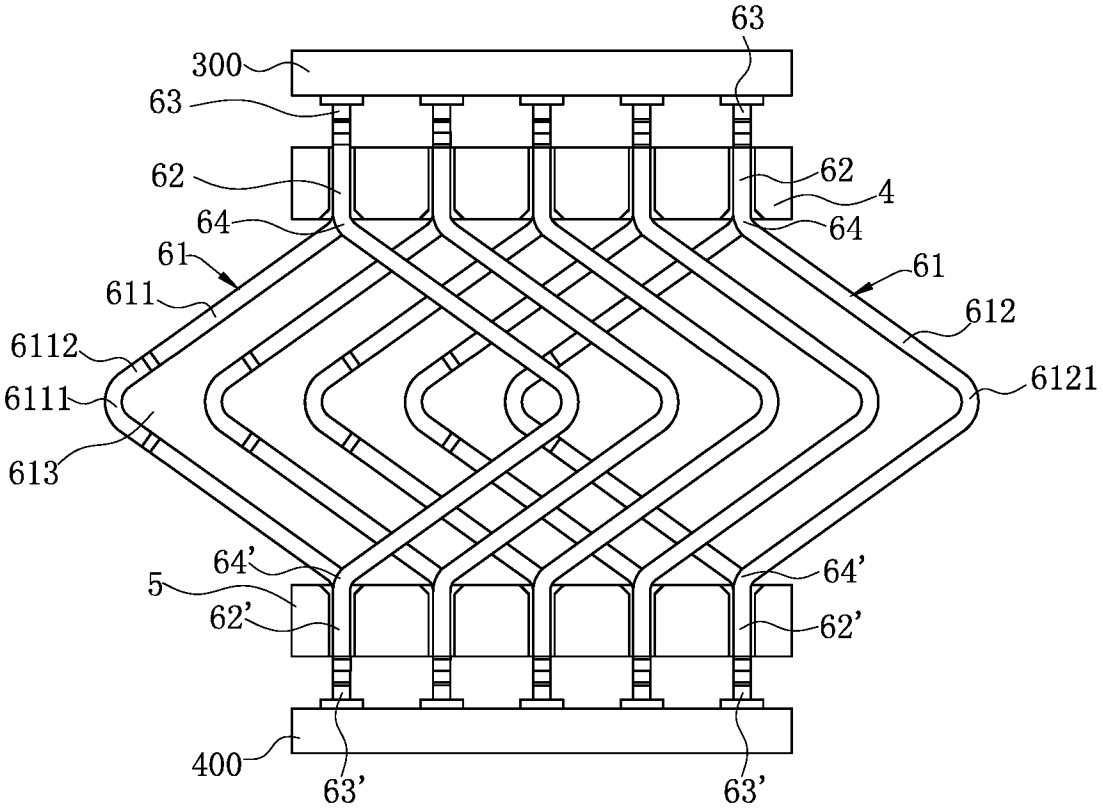
FIG. 8 is a side view of the electrical connector according to the second embodiment of the present invention, wherein the conductive terminals are compressed.

A first arrangement direction is defined to be perpendicular to a vertical direction, and a second arrangement direction is defined to be perpendicular to the first arrangement direction. As shown in FIG. 6, the conductive terminals 6 are arranged in a matrix along the first arrangement direction and the second arrangement direction. The bending directions of the first bending portion 6111 and the second bending portion 6121, i.e., the bending directions of the first elastic arm 611 and the second elastic arm 612, are parallel to the first arrangement direction. As shown in FIG. 7, two adjacent conductive terminals 6 are arranged along the first arrangement direction, and the first bending portion 6111 of one of the two adjacent conductive terminals 6 passes beyond the second bending portion 6121 of the other one of the two adjacent conductive terminals 6 in the bending direction. In the first arrangement direction, the first bending portion 6111 and the second bending portion 6121 of one of the conductive terminals 6 respectively pass beyond the planes on which the upper connecting portions 62 and the lower connecting portions 62' of adjacent conductive terminals 6 are located. Projections of the first elastic arm 611 and the second elastic arm 612 along the second arrangement direction are in mirror symmetry relative to a plane on which the upper connecting portion 62 and the lower connecting portion 62' are located.

Figure 9:
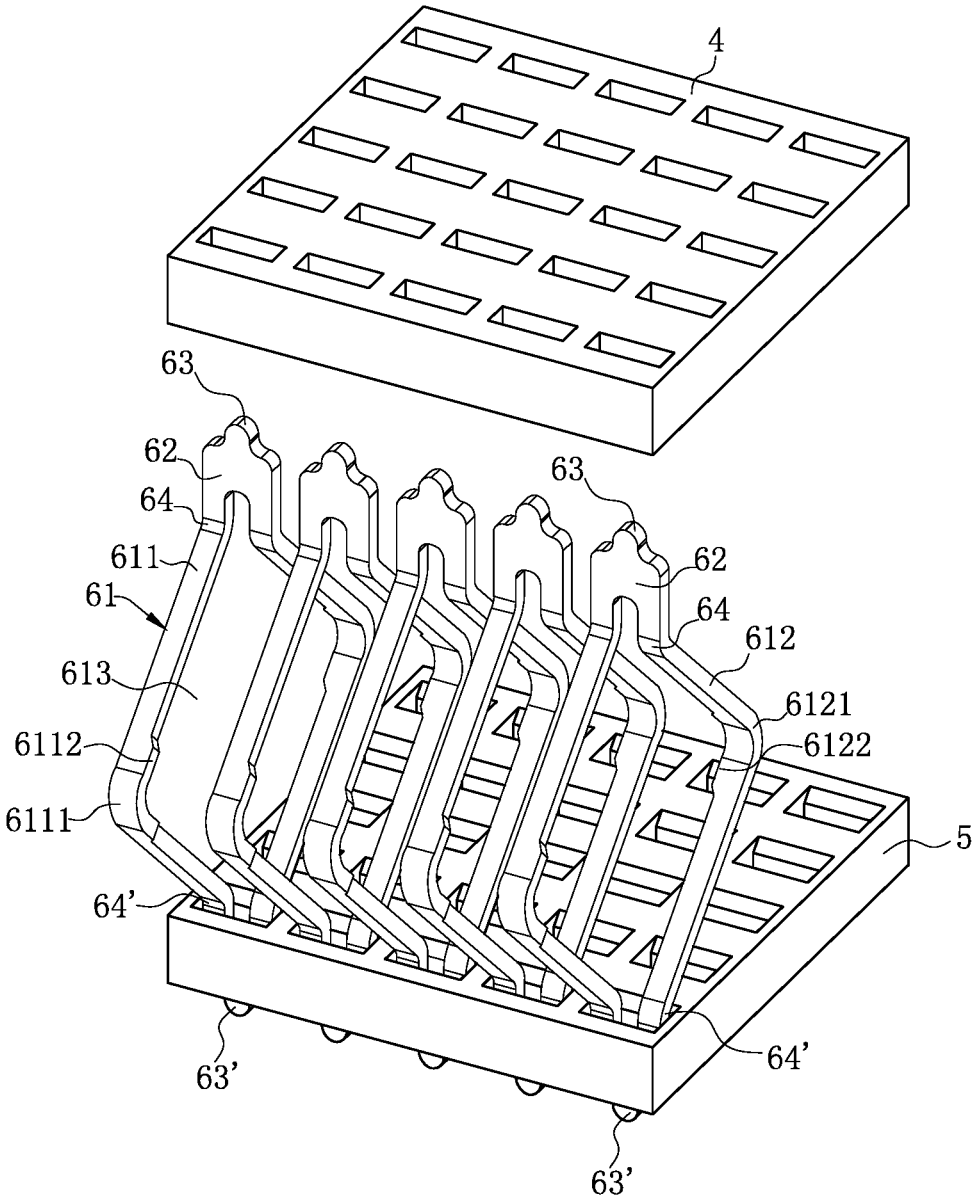
FIG. 9 is an arrangement of the conductive terminals of the electrical connector according to the second embodiment of the present invention.
Figure 10:
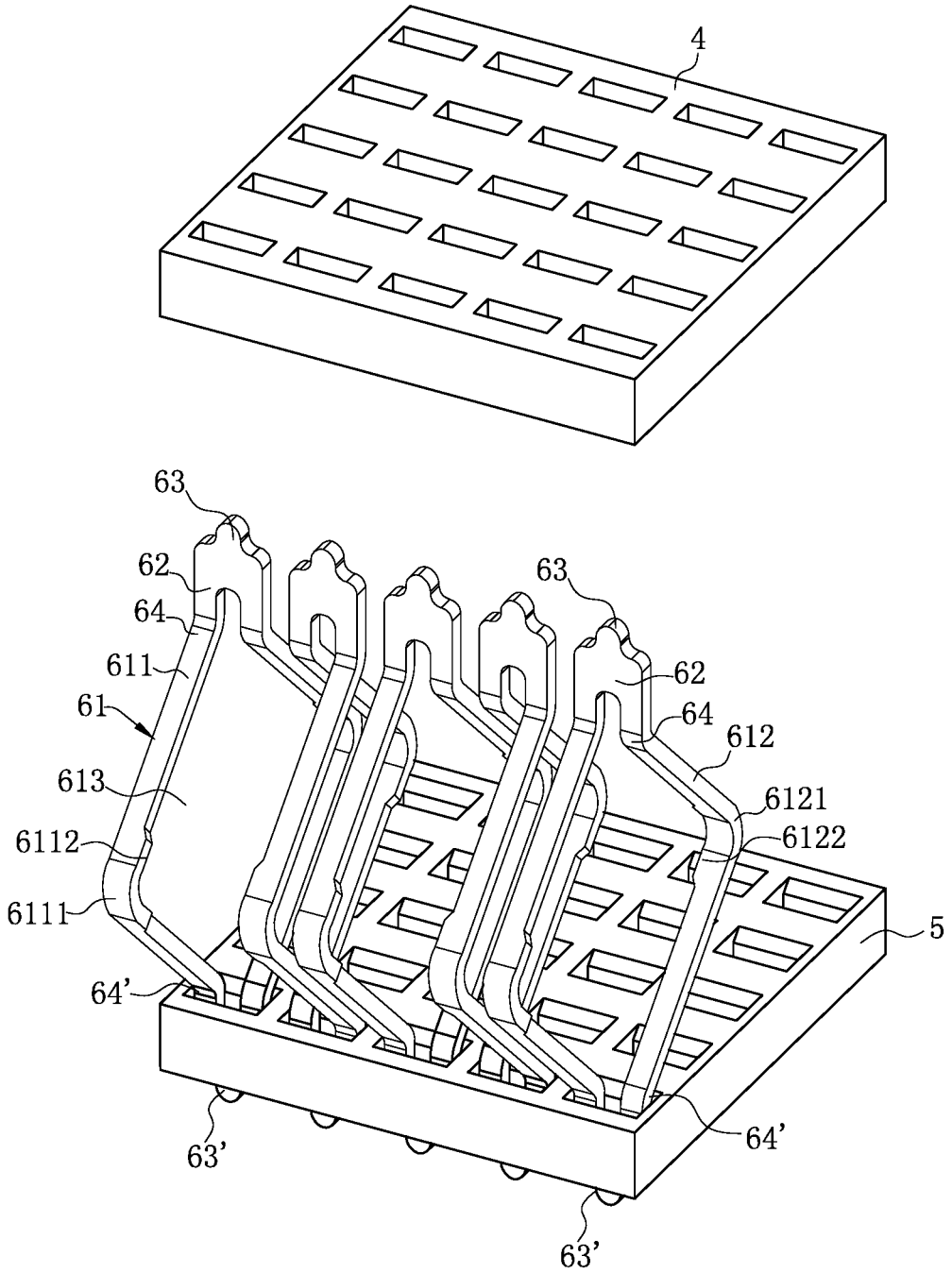
FIG. 10 is another arrangement of the conductive terminals of the electrical connector according to the second embodiment of the present invention.
Figure 11:
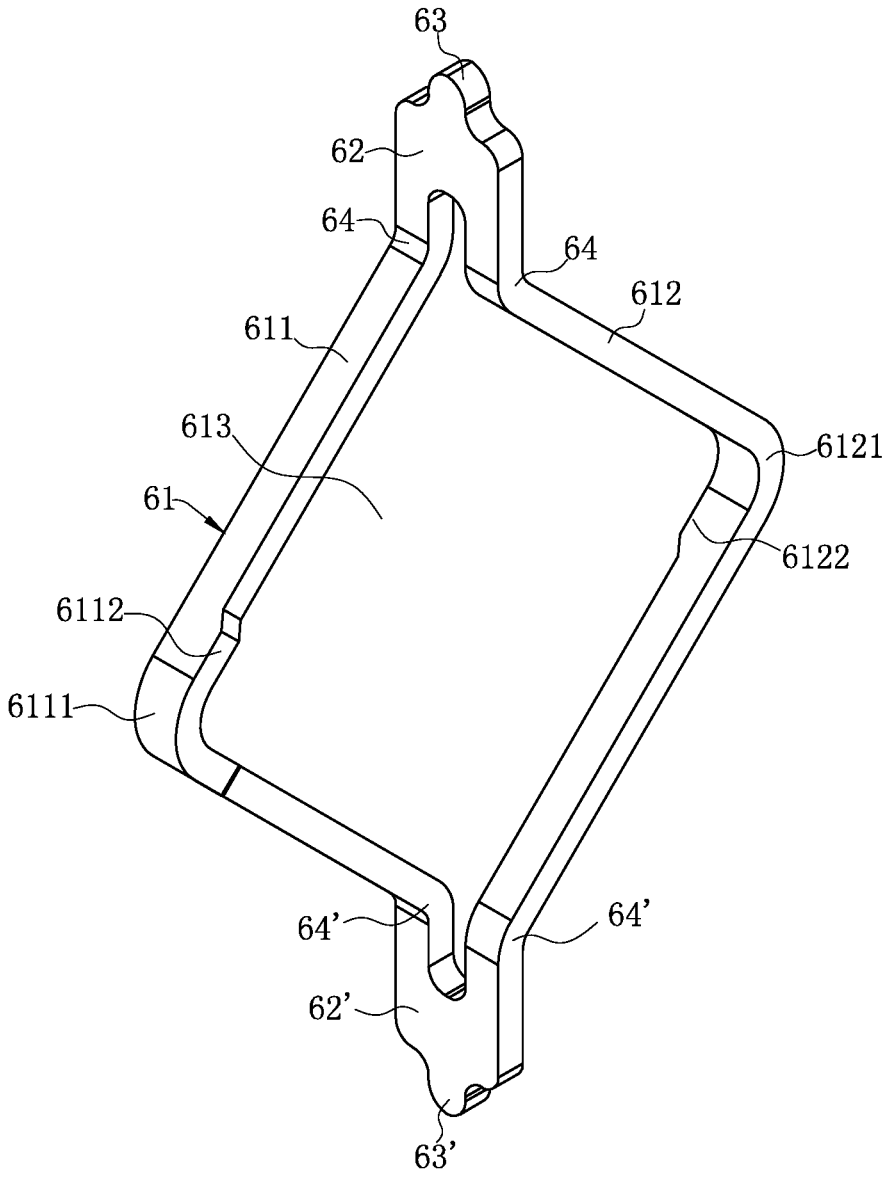
FIG. 11 is a perspective view of the conductive terminals of the electrical connector according to the second embodiment of the present invention.
Figure 12:
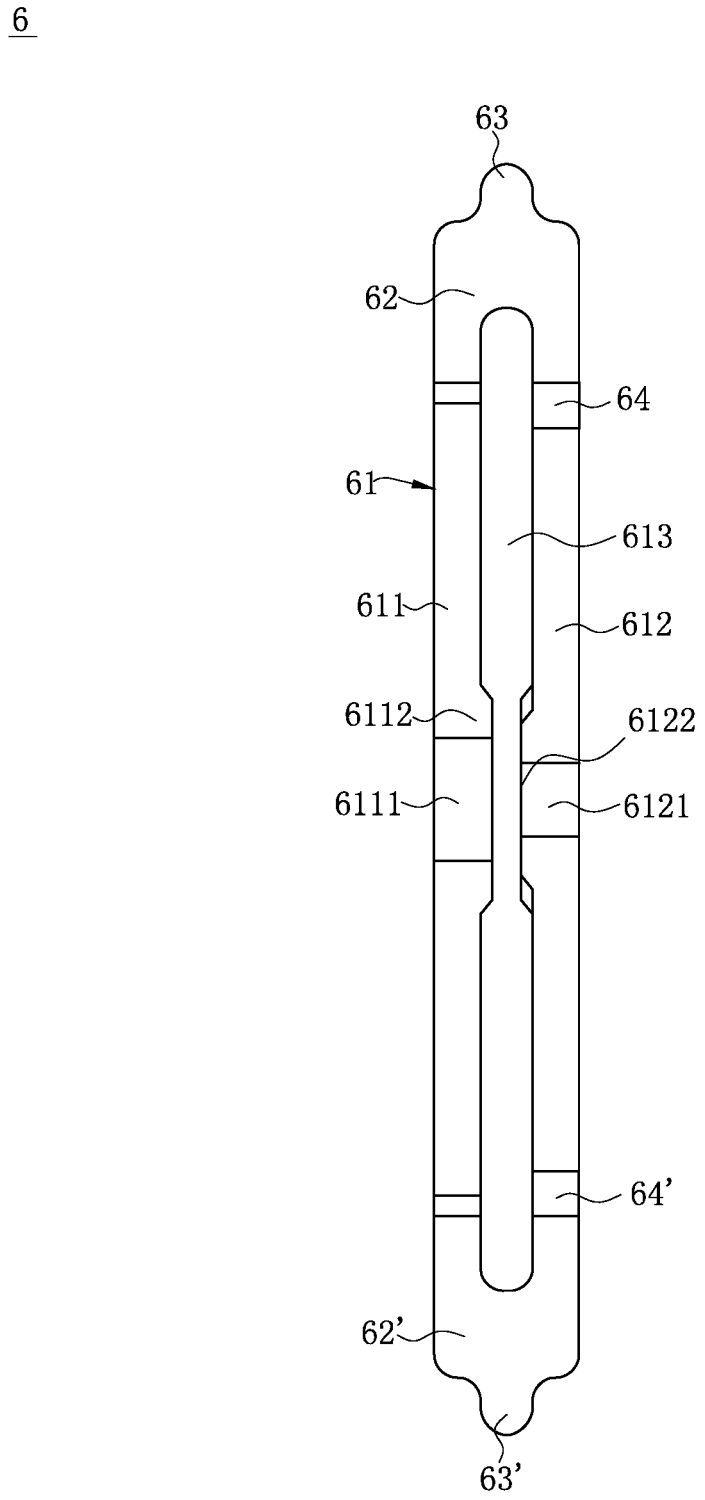
FIG. 12 is a side view of the conductive terminals of the electrical connector according to the second embodiment of the present invention.

As shown in FIG. 9 and FIG. 10, the conductive terminals 6 can be arranged in two arrangements in the second arrangement direction. As shown in FIG. 9, each of the conductive terminals 6 may be located at a position in the second arrangement direction of adjacent conductive terminals 6, and a distance between the two first elastic arms 611 or the two second elastic arms 612 of the two adjacent conductive terminals is greater than a distance between two adjacent channels. As shown in FIG. 10, in the second arrangement direction, the two first elastic arms 611 or the two second elastic arms 612 of any two adjacent conductive terminals 6 are close to each other. That is, a distance between the two first elastic arms 611 and a distance between the two second elastic arms 612 are equal to the distance between the two channels. In other words, in the second arrangement direction, the two adjacent conductive terminals 6 are symmetric to each other relative to a center line between the two. Compared with the arrangement of the conductive terminals 6 as shown in FIG. 9, the arrangement of the conductive terminals 6 as shown in FIG. 10 is capable of reducing crosstalk.

To sum up, the electrical connector according to certain embodiments of the present invention has the following beneficial effects:

(1) The elastic portion 31 of each conductive terminal 3 is provided with the through hole 313, such that the elasticity of the elastic portion 31 is increased, and the chip module 300 presses downward on the conductive terminals 3 more easily.

(2) The first bending portion 3111 and the second bending portion 3121 are provided with the first widening portion 3112 and the second widening portion 3122, so as to avoid fatigue easily caused by excessive narrow width of the elastic portion 31 due to the through hole 313.

(3) The first bending portion 3111 and the second bending portion 3121 are provided with the first widening portion 3112 and the second widening portion 3122, so as to increase the capacitive reactance of the conductive terminal to improve the high frequency transmission performance.

(4) The conductive terminal 3 is provided with the upper position limiting portion 36 and the lower position limiting portion 37 which respectively abut the upper insulating shell 1 and the lower insulating shell 2 so as to limit the protruding distances of the upper contact portion 34 and the lower contact portion 35.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an upper insulating shell and a lower insulating shell; and at least one conductive terminal, wherein the at least one conductive terminal has an elastic portion located between the upper insulating shell and the lower insulating shell, the elastic portion has a first elastic arm and a second elastic arm separate from each other, an upper connecting portion is located above the first elastic arm and the second elastic arm and accommodated in the upper insulating shell, the upper connecting portion extends to form an upper contact portion protruding out of the upper insulating shell, a lower connecting portion is located below the first elastic arm and the second elastic arm and accommodated in the lower insulating shell, and the lower connecting portion extends to form a lower contact portion protruding out of the lower insulating shell;

wherein the first elastic arm has a first bending portion bending toward one side thereof and a first widening portion located on the first bending portion, a width of the first widening portion is greater than a width of a remaining portion of the first elastic arm, the second elastic arm has a second bending portion bending toward one side thereof and a second widening portion located on the second bending portion, and a width of the second widening portion is greater than a width of a remaining portion of the second elastic arm.

2. The electrical connector according to claim 1, wherein the upper insulating shell has at least one upper channel for accommodating the upper connecting portion, an upper position limiting portion is formed between the upper connecting portion and the elastic portion to upward abut the upper insulating shell, the lower insulating shell has at least one lower channel for accommodating the lower connecting portion, and a lower position limiting portion is formed between the lower connecting portion and the elastic portion to downward abut the lower insulating shell.

3. The electrical connector according to claim 1, wherein the first widening portion protrudes from the first bending portion toward the second bending portion, the second widening portion protrudes from the second bending portion toward the first bending portion, and the first widening portion and the second widening portion are provided at an interval.

4. The electrical connector according to claim 1, wherein the first widening portion is located at a center of the first bending portion; and the second widening portion is located at a center of the second bending portion.

5. The electrical connector according to claim 1, wherein the first bending portion is located at a center of the first elastic arm; and the second bending portion is located at a center of the second elastic arm.

6. The electrical connector according to claim 1, wherein the first bending portion and the second bending portion bend toward a same side.

7. The electrical connector according to claim 2, wherein the upper connecting portion, the upper position limiting portion, the first elastic arm, the second elastic arm, the lower position limiting portion and the lower connecting portion enclose a through hole.

8. The electrical connector according to claim 7, wherein a width of the upper connecting portion and a width of the lower connecting portion are respectively smaller than a width of the elastic portion, and a width of the through hole in the upper connecting portion and in the lower connecting portion is smaller than the width of the through hole in the elastic portion.

9. The electrical connector according to claim 2, wherein an included angle between a horizontal projection of the upper channel and a horizontal projection of a side edge of the upper insulating shell is 45°, and an included angle between a horizontal projection of the lower channel and a horizontal projection of a side edge of the lower insulating shell is 45°.

10. The electrical connector according to claim 2, wherein the upper position limiting portion and the lower position limiting portion respectively have two oblique surfaces, the upper channel and the lower channel respectively have two chamfers, and the oblique surfaces abut the chamfers.

11. The electrical connector according to claim 1, wherein the upper connecting portion and the lower connecting portion are flat plate shaped, and the upper connecting portion and the lower connecting portion are coplanar.

12. The electrical connector according to claim 1, wherein the first elastic arm and the second elastic arm bend toward different directions away from each other.

13. The electrical connector according to claim 12, wherein a first arrangement direction is defined to be perpendicular to a vertical direction, and two adjacent conductive terminals are arranged along the first arrangement direction, wherein the first bending portion of one of the two adjacent conductive terminals, in a bending direction, passes beyond the second bending portion of the other of the two adjacent conductive terminals.

14. The electrical connector according to claim 13, wherein a second arrangement direction is defined to be perpendicular to the first arrangement direction, the upper connecting portion and the lower connecting portion are flat plate shaped, and projections of the first elastic arm and the second elastic arm along the second arrangement direction are in mirror symmetry relative to a plane on which the upper connecting portion and the lower connecting portion are located.

15. The electrical connector according to claim 14, wherein two conductive terminals are arranged along the second arrangement direction and adjacent to each other, and in the second arrangement direction, the two conductive terminals are symmetric to each other relative to a center line between the two conductive terminals.

16. The electrical connector according to claim 14, wherein in the first arrangement direction, the first bending portion and the second bending portion of one of the conductive terminals respectively pass beyond the planes on which the upper connecting portions and the lower connecting portions of adjacent conductive terminals are located.

* * * * *